US010150126B2

(12) United States Patent
Lee

(10) Patent No.: US 10,150,126 B2
(45) Date of Patent: Dec. 11, 2018

(54) COSMETIC CONTAINER CAPABLE OF STORING AND DISCHARGING TWO KINDS OF CONTENTS

(71) Applicant: PUM-TECH KOREA CO., LTD, Incheon (KR)

(72) Inventor: Do Hoon Lee, Incheon (KR)

(73) Assignee: PUM-TECH KOREA CO., LTD., Incheon (KR)

( * ) Notice: Subject to any disclaimer, the term of this patent is extended or adjusted under 35 U.S.C. 154(b) by 27 days.

(21) Appl. No.: 14/912,580

(22) PCT Filed: Aug. 21, 2014

(86) PCT No.: PCT/KR2014/007750
§ 371 (c)(1),
(2) Date: Feb. 17, 2016

(87) PCT Pub. No.: WO2015/026168
PCT Pub. Date: Feb. 26, 2015

(65) Prior Publication Data

US 2016/0199863 A1 Jul. 14, 2016

(30) Foreign Application Priority Data

Aug. 22, 2013 (KR) ..... 20-2013-0007038 U

(51) Int. Cl.
*B05B 11/00* (2006.01)
*A45D 34/00* (2006.01)
*A45D 40/24* (2006.01)

(52) U.S. Cl.
CPC ..... *B05B 11/3001* (2013.01); *A45D 34/00* (2013.01); *B05B 11/3052* (2013.01);
(Continued)

(58) Field of Classification Search
CPC ..... B65B 11/3084; B05B 11/3084; B05B 11/0037; B05B 11/0043; B05B 11/0048;
(Continued)

(56) References Cited

U.S. PATENT DOCUMENTS 4,830,227 A * 5/1989 Ball ..... A47K 5/1215 222/207
4,913,322 A * 4/1990 Stoffler ..... B05B 11/0048 222/207
(Continued)

FOREIGN PATENT DOCUMENTS

KR 20-0442446 Y1 11/2008
KR 20-2010-0010657 U 10/2010
(Continued)

*Primary Examiner* — Patrick M Buechner
*Assistant Examiner* — Michael J Melaragno
(74) *Attorney, Agent, or Firm* — Heedong Chae; Lucem, PC

(57) ABSTRACT

The present invention relates to a cosmetic container capable of discharging two kinds of contents including a lower container body (200) for accommodating first and second containers (202, 203) which are coupled to a lower cap (201) and have cosmetic contents filled therein; airless pumps (300) including piston parts (301) provided in opening portions of the first and second containers (202, 203), and piston housings (303) provided on the outer periphery portions of the piston parts (301) and having pressing protrusions (302); button housings (400) for accommodating side buttons (500) which slide by pressing the pressing protrusions (302); and a mixture discharge member (700) which is coupled to the upper parts of the button housings (400) so as to discharge the cosmetic contents, and which is dented in a dish shape.

2 Claims, 6 Drawing Sheets

(52) U.S. Cl.
CPC ..... *B05B 11/3084* (2013.01); *A45D 40/24* (2013.01); *A45D 2200/056* (2013.01); *A45D 2200/058* (2013.01); *B05B 11/007* (2013.01); *B05B 11/0037* (2013.01); *B05B 11/0072* (2013.01); *B05B 11/00412* (2018.08); *B05B 11/00416* (2018.08); *B05B 11/3023* (2013.01); *B05B 11/3069* (2013.01); *B05B 11/3085* (2013.01)

(58) Field of Classification Search
CPC ..... B05B 11/007; B05B 11/0072; B05B 11/3023; A45D 34/00; A45D 40/24; A45D 2200/056; A45D 2200/058
USPC ..... 222/135, 321.8, 571; 239/304
See application file for complete search history.

(56) References Cited

U.S. PATENT DOCUMENTS 4,946,076 A * 8/1990 Hackmann ..... B05B 11/0048 222/207
5,020,930 A * 6/1991 Kuhn ..... A47L 23/05 222/213
5,052,592 A * 10/1991 Wilken ..... B65D 83/0033 222/212
5,197,637 A * 3/1993 Naumann ..... B05B 11/0051 222/207
5,377,880 A * 1/1995 Moretti ..... B05B 11/0072 222/207
5,704,522 A * 1/1998 Orgeolet ..... F16K 15/148 222/494
5,740,947 A * 4/1998 Flaig ..... B65D 81/3288 220/23.4
5,862,955 A * 1/1999 Albini ..... B05B 11/0048 222/212
7,854,350 B2 * 12/2010 Lasserre ..... B65D 83/68 222/135
7,946,452 B2 * 5/2011 Hantman ..... B29C 49/0078 215/10
8,814,002 B2 * 8/2014 Pires ..... G01F 11/021 222/135
D721,284 S * 1/2015 Yeo ..... D9/684
9,180,475 B2 * 11/2015 Cho ..... B05B 11/0037
9,585,459 B2 * 3/2017 Kim ..... A45D 40/0068
2003/0089738 A1 * 5/2003 Peterson ..... B05B 11/0078 222/135
2004/0050869 A1 * 3/2004 Jennings ..... A61M 15/009 222/183
2004/0056049 A1 * 3/2004 Stradella ..... A61M 15/0065 222/321.7
2004/0112918 A1 * 6/2004 Decottignies ..... B65D 83/0061 222/105
2004/0188464 A1 * 9/2004 Auer ..... B05B 11/0064 222/135
2005/0205611 A1 * 9/2005 Bonney ..... B05B 11/0048 222/282
2006/0000926 A1 * 1/2006 Decottignies ..... B05B 11/3084 239/302
2007/0045343 A1 * 3/2007 Lasserre ..... B65D 83/20 222/135
2007/0045344 A1 * 3/2007 Lasserre ..... B65D 83/20 222/135
2007/0095853 A1 * 5/2007 Bonney ..... B05B 11/3056 222/21
2007/0108231 A1 * 5/2007 Gray ..... B01F 5/0603 222/135
2009/0308890 A1 * 12/2009 Saravis ..... B05B 11/3015 222/135
2010/0044394 A1 * 2/2010 Milian ..... B05B 11/3007 222/135
2010/0308082 A1 * 12/2010 Lamble ..... A61M 15/009 222/162
2011/0315574 A1 * 12/2011 Lee ..... A45D 34/00 206/219
2012/0267391 A1 * 10/2012 Yoo ..... A45D 34/00 222/41
2012/0267398 A1 * 10/2012 Lim ..... A45D 34/04 222/256
2012/0298694 A1 * 11/2012 Holzmann ..... B05B 11/3056 222/135
2013/0026187 A1 * 1/2013 Kim ..... A45D 34/00 222/153.13
2013/0284763 A1 * 10/2013 Banks ..... B01F 5/0478 222/190
2014/0020706 A1 * 1/2014 Thiebaut ..... A45D 19/02 132/314
2015/0090739 A1 * 4/2015 Jung ..... B05B 11/0024 222/205
2015/0274398 A1 * 10/2015 Kim ..... A45D 34/00 222/129
2015/0298149 A1 * 10/2015 Alluigi ..... B05B 11/3025 222/135
2015/0305474 A1 * 10/2015 Ham ..... A45D 34/00 222/135
2016/0073762 A1 * 3/2016 Lee ..... A45D 34/04 222/145.6
2016/0158781 A1 * 6/2016 Ki ..... A45D 34/00 222/135
2016/0199863 A1 * 7/2016 Lee ..... A45D 34/00 222/135
2016/0206079 A1 * 7/2016 Lee ..... B65D 81/325
2016/0235183 A1 * 8/2016 Lee ..... B05B 15/002
2016/0286932 A1 * 10/2016 Lee ..... A45D 34/00

FOREIGN PATENT DOCUMENTS

KR 20-0461424 Y1 7/2012
KR 10-1190224 B1 10/2012

* cited by examiner

Prior Art

Prior Art

COSMETIC CONTAINER CAPABLE OF STORING AND DISCHARGING TWO KINDS OF CONTENTS

TECHNICAL FIELD

The present invention relates to a cosmetic container capable of discharging two kinds of contents and, particularly, to a cosmetic container capable of discharging two kinds of contents, wherein a mixture discharge member provided on an upper part of the cosmetic container is concavely formed in a dish shape such that cosmetic contents may be collected into the center of the concaved portion of the mixture discharge member when the cosmetic contents are discharged, and the cosmetic contents which ascend due to the discharge pressure by the operation of an airless pump tray be discharged to have a low pressure by opening/closing nozzle unit coupled to a discharge hole of the mixture discharge member.

BACKGROUND ART

In case of liquid-type cosmetics or gel-type cosmetics having low viscosity such as lotion, cream, gel, shampoo, rinse, etc., an airless pump is provided into a cosmetic container to allow the cosmetics to be easily discharged to be used.

The cosmetic container containing the cosmetics having such coefficient of viscosity is designed to discharge the contained contents by a small amount, and is particularly applied to a container containing functional cosmetics.

In addition, the airless pump applied to the cosmetic container is used for a heterogeneous-contents mixing cosmetic container which mixes and discharges two kinds of contents having mutually different components. In other words, there are products having improved effects when contents having mutually different components are mixed to be used, as one kind of functional cosmetics. The airless pump may be mounted on a container for functional cosmetics to discharge the contents.

A heterogeneous-content mixing cosmetic container according to the related art is disclosed in Korean Register Patent No. 1037361. FIGS. 1 to 3 are views showing a heterogeneous-contents mixing cosmetic container for mixing two kinds of contents having mutually different components. The heterogeneous-contents mixing cosmetic container includes a pair of keeping containers 400 and 400' for containing cosmetic contents, which are provided in an outer container 300 provided at a low side of the cosmetic container; low pistons 411 and 411' provided in a lower part of the keeping containers 400 and 400', respectively to be lifted up every time that the cosmetic contents are consumed; upper pistons provided on opening parts of the keeping containers 400 and 400' to discharge cosmetic contents; piston rods 430 and 430' provided to the upper pistons to move down when being pressed by a pair of buttons 200 and 200'; and cosmetic discharge parts 120 and 120' through which the contents pumped according to the reciprocating operations of the piston rods 430 and 430' are discharged, wherein the cosmetic discharge parts 120 and 120' are coupled to rubber tips 140 coupled to an inclined mixing part 110.

When the buttons 200 and 200' are pressed, the connecting pieces move down the piston rods 430 and 430', so that the piston rods 430 and 430' move down to open check valves 451 and 451', thereby discharging the cosmetic contents contained in the keeping containers 400 and 400' into the mixing part 110 through the cosmetic discharge parts 120 and 120'.

Thus, the cosmetic contents transferred along paths of the cosmetic discharge parts 120 and 120' are discharged into the mixing part 110 so that the mixture of two kinds of cosmetic contents may be used. However, since the cosmetic discharge parts 120 and 120' are vertically penetrated, the discharged cosmetic contents are spouted out due to the high pressure so that the cosmetic contents are sputtered near the cosmetic container, so cosmetics are wasted.

In addition, after the cosmetic contents discharged through the cosmetic discharge parts 120 and 120' and mixed in the mixing part 110 are used, residuals of cosmetic contents are retrain in plural gaps existing on a boundary surface of the mixing part 110, so that trouble may be caused on a skin.

DISCLOSURE

Technical Problem

To solve the problems described above, an object of the present invention is to provide a cosmetic container capable of discharging two kinds of contents, which is capable or collecting cosmetic contents at a central portion by concavely forming a mixture discharge member provided on an upper part of the cosmetic container to have a dish shape.

Another object of the present invention is to provide a cosmetic container capable of discharging two kinds of contents, which is capable of discharging the cosmetic contents moving up due to the discharge pressure by the operation of an airless pump at a low pressure by an opening/closing nozzle unit coupled to the discharge hole of a mixture discharge member.

Technical Solution

To achieve the objects, there is provided a cosmetic container which is capable of storing and discharging two kinds of contents, which includes: a lower container body (200) coupled to a lower cap (201) in a lower part of the cosmetic container (100) to receive first and second containers (202 and 203) filled with cosmetic contents; an airless pump (300) including a piston part (301) provided on opening parts of the first, and second containers (202 and 203), and a piston housing (303) having a pressing protrusion (302) and provided on an outer periphery part of the piston part (301); a button housing (400) receiving a side button (500) which slides while pressing the pressing protrusion (302); and a mixture discharge member (700) coupled to an upper part of the button housing (400) to discharge cosmetic contents therethrough and concavely formed in a dish shape, wherein the mixture discharge member (700) is provided with a discharge hole (701) through which the cosmetic contents are discharged by the airless pimp (300), and the discharge hole (701) is provided with an opening/closing nozzle unit which allows the cosmetic contents discharged at a discharge pressure by the airless pump 300 to be discharged at a low pressure.

Advantageous Effects

According to the present invention, the cosmetic contents are discharged into the mixture discharge member provided on the tipper part of the cosmetic container when being discharged from the cosmetic container. In this case, the cosmetic contents, which move up due to the discharge pressure by the airless pump, are induced to the discharge hole by a low pressure, so that the cosmetic contents are prevented from being spouted out like a fountain due to a high pressure, thereby preventing the cosmetic contents from falling to a floor. Thus, the makeup place may be maintained clean. In addition, after two kinds of cosmetic contents are discharged, the two kinds of cosmetic contents discharged from the mixture discharge member may be mixed with each other to be used.

BEST MODE

Mode for Invention

Hereinafter, the present invention will be described in detail with reference to accompanying drawings.

Figure 1:
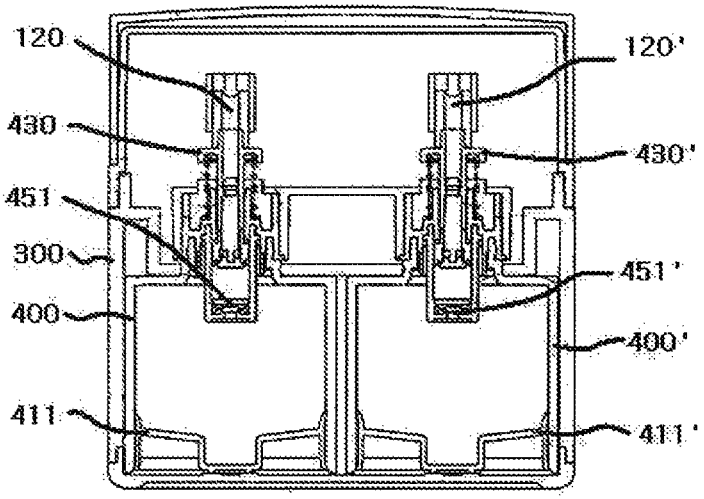
FIGS. 1 to 3 are side sectional and perspective views showing a cosmetic container for mixing heterogeneous contents according to the related art.
Figure 2:
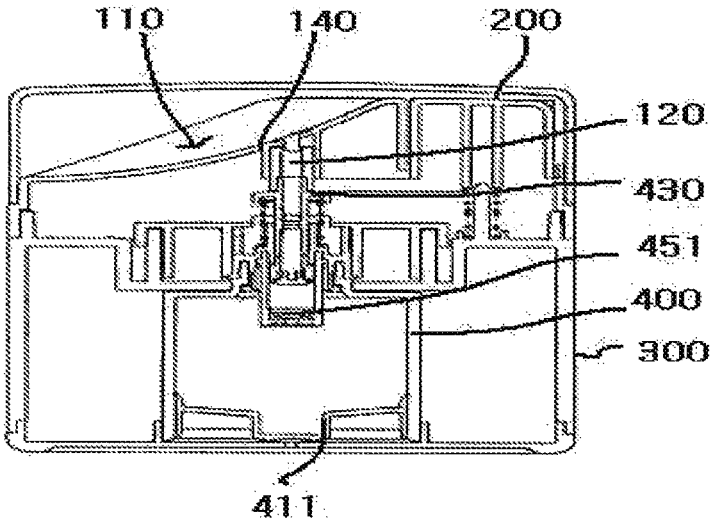
Prior Art FIG. 2
Figure 3:
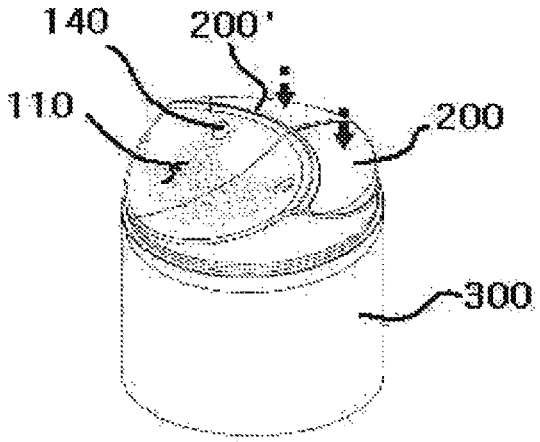
Figure 4:
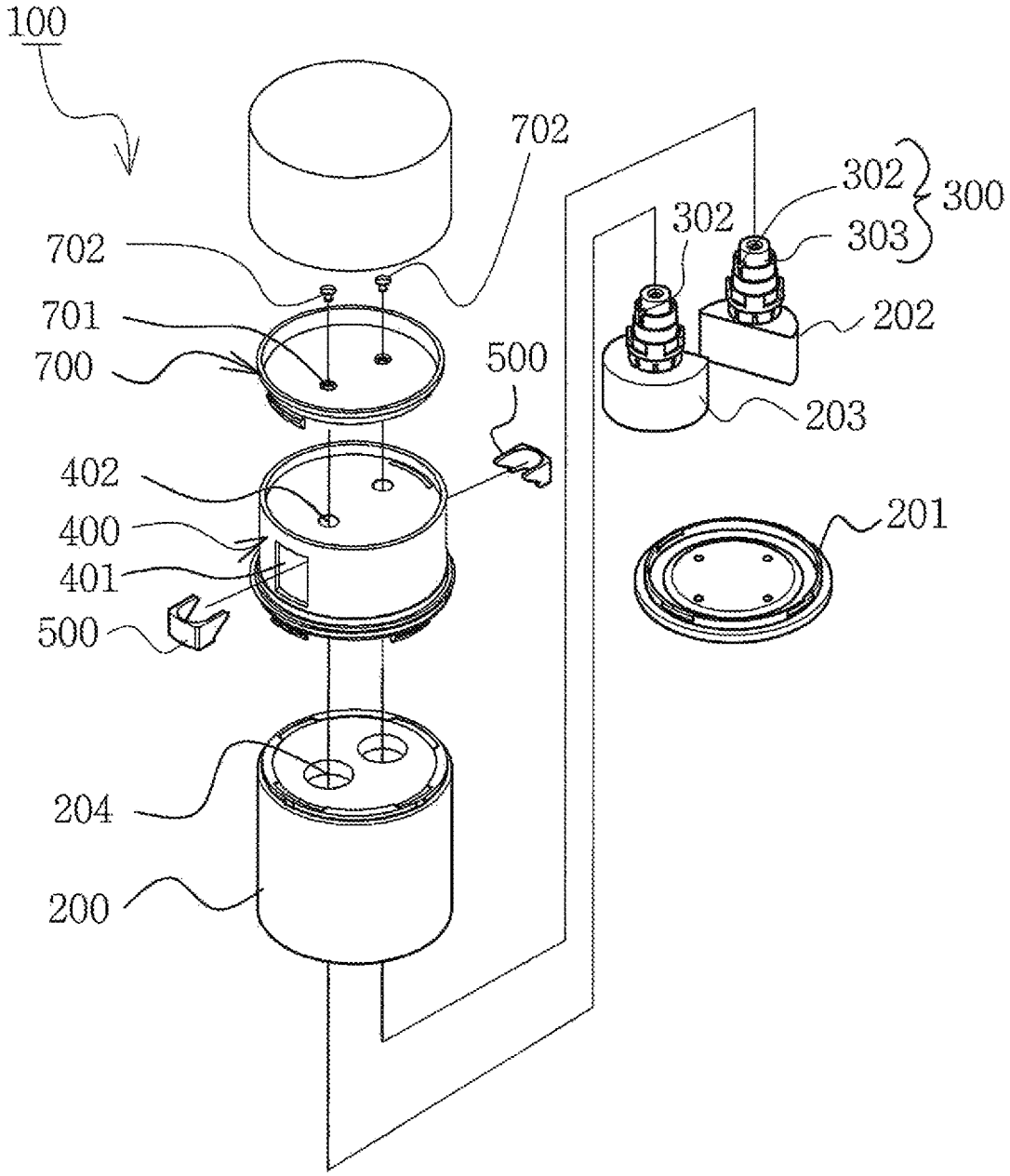
FIG. 4 is an exploded perspective view of the present invention.
Figure 5:
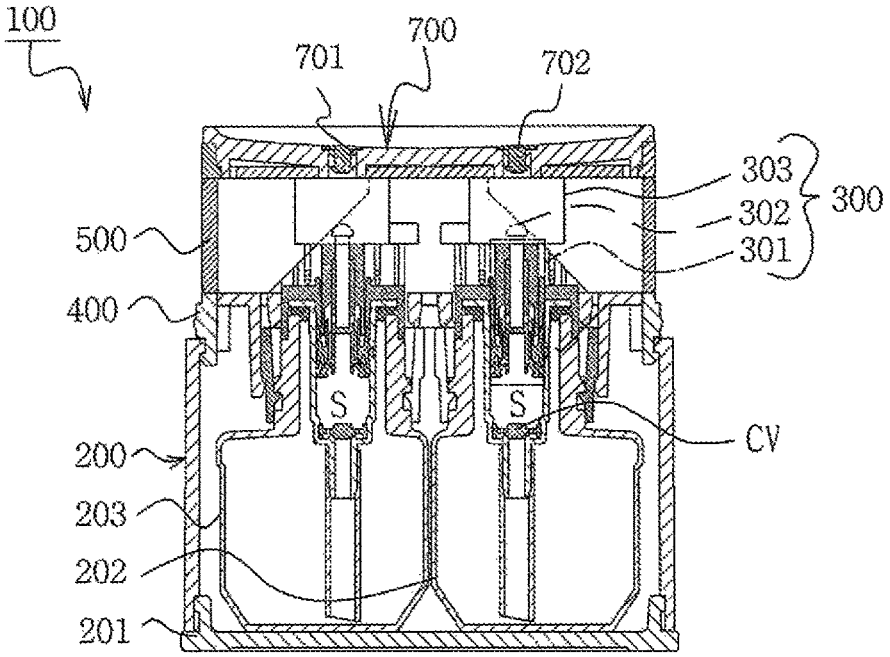
FIG. 5 is a sectional view of all of the present invention.

First, as shown in FIGS. 4 and 5, a cosmetic container, which is capable of storing and discharging two kinds of contents, includes a lower container body 200 coupled to a lower cap 201 in a lower part of the cosmetic container 100 and receiving first and second containers 202 and 203 which are coupled to a lower cap 201 and filled with cosmetic contents; an airless pump (300) including a piston part (301) provided on opening parts of the first and second containers (202 and 203), and a piston housing (303) having a pressing protrusion (302) and provided on an outer periphery part of the piston part (301); a piston hole 204 formed at an upper side of the lower container body 200 to receive the piston housing 303; a button housing 400 provided at a lower side of the lower container body 200 through an under-cut scheme and coupled to an edge of the piston hole 204; side buttons 500 which are installed into button receiving holes 401 provided at both sides of an outer periphery part of the button housing 400 and which slides while pressing the pressing protrusion 302; and a mixture discharge member 700 coupled to valve holes 402 for receiving a discharge valve 600 at an upper side of the button hosing 400 such that the cosmetic contents discharged by the airless pump 300 is discharged through the discharge valve 600, wherein the mixture discharge member 700 is concavely formed in a dish shape and is coupled to an edge of the button housing 400, discharge holes 701 are formed in the mixture discharge member 700, through which the cosmetic contents are discharged by the airless pump 300; and an opening/closing nozzle unit 702 is provided to the discharge holes 701 and coverts the discharge pressure of the cosmetic contents discharged therethrough by the airless pump 300 into a low pressure.

Discharge ribs 701' are formed on an inner periphery of the discharge hole 701.

The number of the discharge ribs 701' is preferably set according to the quantity of the discharge contents.

The opening/closing nozzle unit 702 includes a blocking piece 702*a* to which the discharge pressure is directly applied by the airless pump 300, a transfer hole 702*b* for guiding the cosmetic contents which are transferred while being dispersed into both sides by the blocking piece 702*a*, and an opening/closing wing piece 702*c* for discharging the cosmetic contents transferred upward by the guide of the transfer hole 702*b* at small quantity.

The opening/closing nozzle unit 702 allows the discharge pressure of the cosmetic contents discharged by the airless pump 300 to be converted into a low pressure and may be formed of an elastic material such that the cosmetic contents may be discharged even at a low pressure through the discharge hole 701.

The operation of the present invention described above is as follows.

Figure 6A:
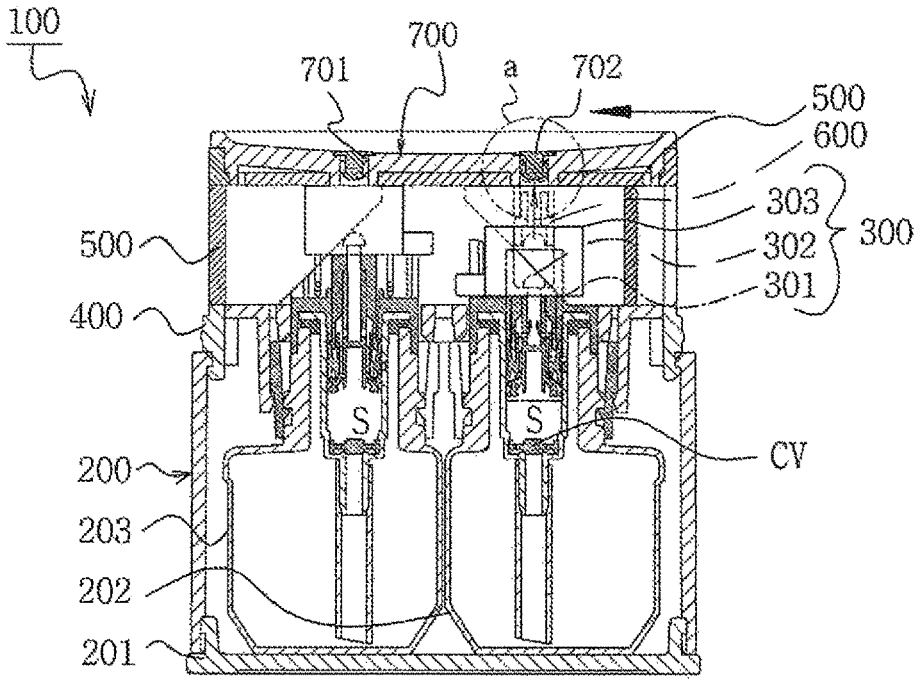
FIGS. 6*a* and 6*b* are sectional views showing a state that one kind or two kinds of cosmetic contents are discharged by pushing a side button applied to the present invention.

As shown in FIG. 6*a*, when the side button 500 at one side is pushed into the inside of the button housing 400 in order to selectively use one of the first and second storing containers 202 and 203 is to be selectively used, while the side button 500 slides into the button housing 400, the inclined surface formed at a lower side of the side button 500 presses downward the pressing protrusion 302 protruding from the upper portion of the airless pump 300.

Thus, the airless pump 300 moves down and the cosmetic contents in a temporary storage room S rise along a transfer passage of the piston part 301 while a content transfer passage in the airless pump 300 is opened, so that the cosmetic contents are transferred into the discharge hole 701. The discharge pressure of the cosmetic contents rising by the airless pump 300 is converted into a low pressure due to the resistance of blocking piece 702*a* provided to the opening/closing 702 so that the cosmetic contents are dispersed into both sides by the blocking piece 702*a* and move up along the transfer hole 702*b*.

Figure 8:
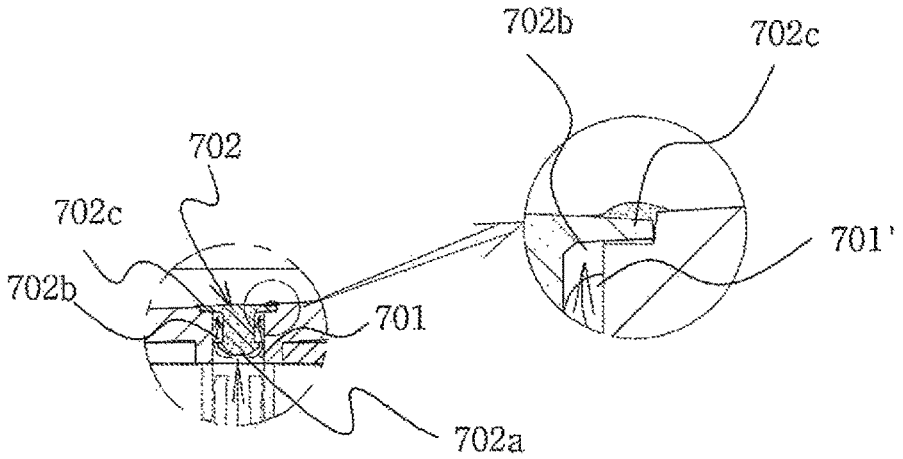
FIG. 8 is a partially enlarged view of part of FIG. 6*a*.

After the cosmetic contents mow up along the transfer-hole 702*b* as described above, as shown in FIG. 8, when the cosmetic contents arrives on the opening/closing wing piece 702*c*, while an end of the opening/closing wing piece 702*c* rises up by a predetermined distance due to the cosmetic contents having the converted low pressure, a small amount of cosmetic contents is discharged into the discharge hole 701 provided at one side of the mixture discharge member 700.

Figure 9:
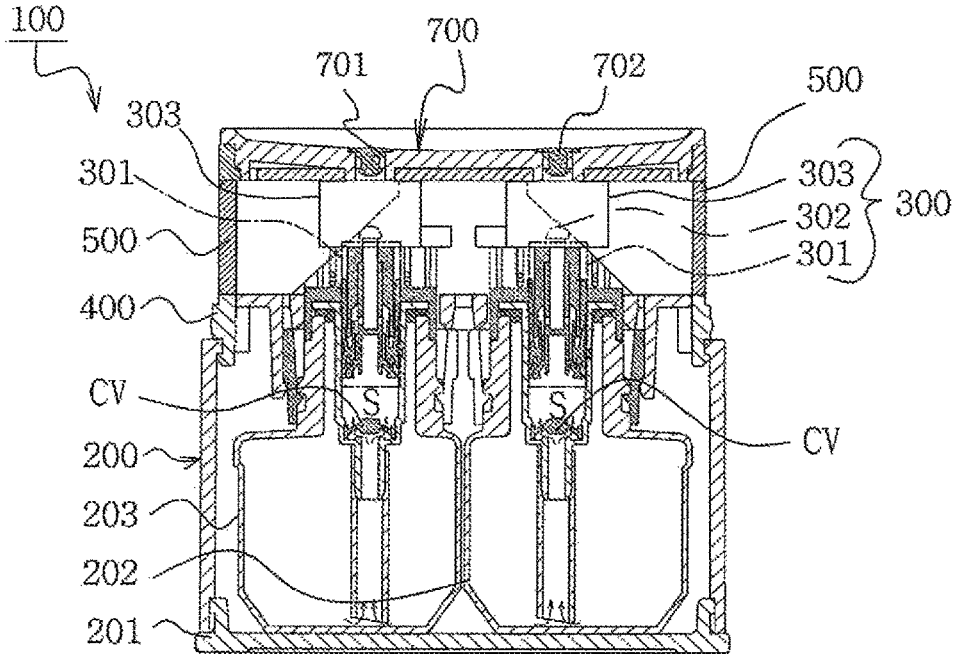
FIG. 9 is a view showing a state that an airless pump is operated according to removal of pressure on a side button applied to the present invention.

When the pressure on the side button 500 is removed after the cosmetic contents are discharged through the mixture discharge member 700, the airless pump 300 moves up by the elastic member provided in the airless pump 300 and at the same time, the pressing protrusion 302 pushes the inclined surface of the side button 500 to allow the side button 500 to return to the original position. In addition, as shown in FIG. 9, while the piston part 301 in the airless pimp 300 moves up, the transfer passage of the cosmetic contents is shut off to generate vacuum pressure from the airless pump 300, so that the cosmetic contents in the first storage container 202 moves up to be filled into the temporary storage roove S while the check valve CV is opened.

Meanwhile, when the mixture, which is obtained by simultaneously discharging two cosmetic contents stored in each of the first and second storage containers 202 and 203 to be mixed with each other, is used, the side buttons 500 of both sides are simultaneously pushed. In this case, the operations of the side buttons 500 and the airless pump 300 are as follows.

Figure 6B:
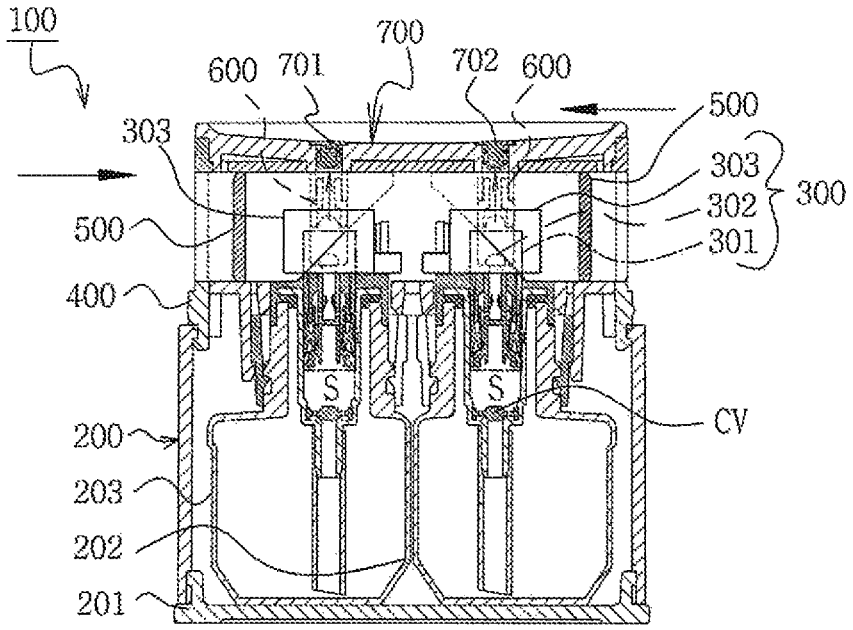
Figure 7:
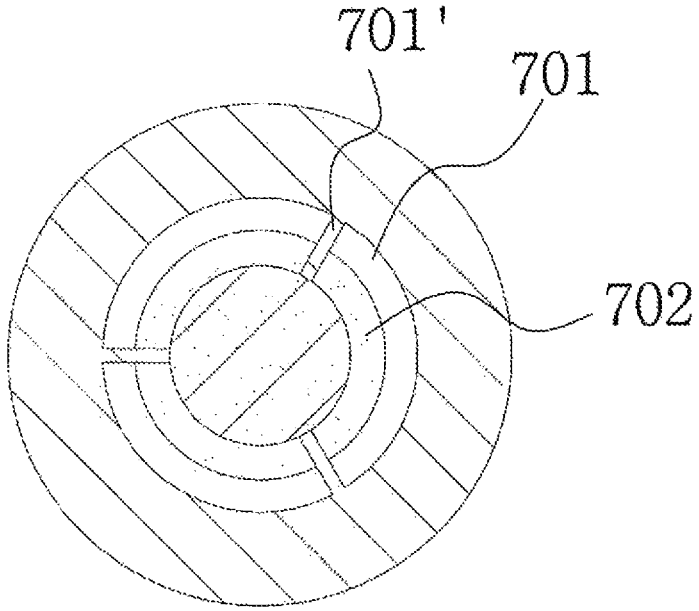
FIG. 7 is a sectional plan view of an opening/closing nozzle unit applied to the present invention.

That is, as shown in FIG. 6*b*, when both side buttons 500 are pushed into the button housing 400, while the side buttons 500 slide into the button housing 400, the inclined surfaces formed at lower sides of the side buttons 500 press downward the pressing protrusions 302 protruding from the upper portions of the airless pumps 300.

Thus, the airless pumps 300 move down and the cosmetic contents in the temporary storage rooms S rise along the transfer passages of the piston parts 301 while the content transfer passages in the airless pumps 300 are opened, so that the cosmetic contents are transferred into the discharge holes 701. The discharge pressures of the cosmetic contents rising by the airless pumps 300 are converted into the low pressures due to the resistance of blocking pieces 702*a* provided to the opening/closing unit 702 so that the cosmetic contents are dispersed into both sides by the blocking pieces 702*a* and move up along the transfer holes 702*b*.

After the cosmetic contents move up along the transfer holes 702*b* as described above, when the cosmetic contents arrive on the opening/closing wing pieces 702*c*, while the ends of the opening/closing wing pieces 702*c* rise up by the predetermined distance due to the cosmetic contents having the converted low pressure, small amounts of cosmetic contents are discharged into the discharge holes 701 provided at both sides of the mixture discharge member 700.

When the pressures on both side buttons 500 are removed after the cosmetic contents are discharged through the mixture discharge member 700, the airless pumps 300 move up by the elastic members provided in both airless pumps 300 and at the same time, the pressing protrusions 302 push the inclined surfaces of both side buttons 500 to allow both side button 500 to return to the original positions, respectively. In addition, while the piston parts 301 in the airless pumps 300 move up, the transfer passages of the cosmetic contents are shut off to generate vacuum pressure from the airless pumps 300, so that the cosmetic contents in the first and second storage containers 202 and 203 move up to be filled into both temporary storage rooves S while the check valves CV are opened.

Although an exemplary embodiment of the present invention has been described for illustrative purposes, those skilled in the art will appreciate that various modifications, additions and substitutions are possible, without departing from the scope and spirit of the invention as disclosed in the accompanying claims.

DESCRIPTION OF REFERENCE NUMERAL

100: Cosmetic container
201: Lower cap
202: First container
203: Second container
300: Airless pump
301: Piston part
302: Pressing protrusion
303: Piston housing
400: Button housing
500: Side button
600: Discharge valve
700: Mixture discharge member
702: Opening/closing nozzle unit

The invention claimed is:

1. A cosmetic container which is capable of storing and discharging two kinds of contents, the cosmetic container comprising:

a lower container body (200) coupled to a lower cap (201) in a lower part of the cosmetic container (100) to receive first and second containers (202 and 203) filled with cosmetic contents;

an airless pump (300) including a piston part (301) provided on opening parts of the first and second containers (202 and 203), and a piston housing (303) having a pressing protrusion (302) and provided on an outer periphery part of the piston part (301);

a button housing (400) receiving a side button (500) which slides while pressing the pressing protrusion (302); and a mixture discharge member (700) coupled to valve holes (402) for receiving a discharge valve (600) at an upper part of the button housing (400) to discharge cosmetic contents therethrough and concavely formed in a dish shape, wherein the mixture discharge member (700) is provided with a discharge hole (701) through which the cosmetic contents are discharged by the airless pump (300) and the discharge hole (701) is provided with an opening/closing nozzle unit (702) which allows the cosmetic contents discharged at a discharge pressure by the airless pump (300) to be discharged at a low pressure, wherein the discharge valve (600) narrows the flow path of the discharged cosmetic contents, wherein a discharge rib (701') formed on an inner periphery part of the discharge hole (701) keep in place the opening/closing nozzle unit (702) in the discharge hole (701) and prevents the opening/closing nozzle unit (702) from sliding out of the discharge hole (701) when the discharge pressure is applied, and wherein the opening/closing nozzle unit (702) comprises:

a body piece wherein the discharge rib (701') is in contact with the body piece to keep the opening/closing nozzle unit (702) in place within the discharge hole (701);

a blocking piece (702*a*); and an opening/closing wing piece (702*c*) wherein the opening/closing wing piece (702*c*) and the blocking piece (702*a*) are formed at opposite ends of the body piece and wherein the blocking piece (702*a*) extends outwardly further than the body piece of the opening/closing nozzle unit (702) such that an outermost diameter of the blocking piece (702*a*) is substantially close to a diameter of the discharge hole (701) which acts as a chokepoint to the discharged cosmetic contents, wherein the opening/closing wing piece (702*c*) extends outwardly further than the body piece of the opening/closing nozzle unit (702), wherein a transfer hole (702*b*) is formed between the body piece of the opening/closing nozzle unit (702) and the inner periphery part of the discharge hole (701) to transfer the cosmetic contents wherein the cosmetic contents are in contact with the body piece and the inner periphery part of the discharge hole (701), wherein the blocking piece (702*a*), the body piece and the opening/closing wing piece (702*c*) are constructed to be unitary structurally, wherein the blocking piece (702*a*) allows transfer of the cosmetic contents to the transfer hole (702*b*) through the chokepoint, wherein the transfer hole (702*b*) is constructed to have a length and a width greater than a distance between the outermost diameter of the blocking piece (702*a*) and the inner wall of the dispensing hole (701), and wherein the opening/closing wing piece (702*c*) allows the cosmetic contents from the transfer hole (702*b*) to be discharged at a small quantity at low pressure.

2. The cosmetic container of claim 1, wherein the opening/closing nozzle unit (702) is formed of an elastic material such that a discharge pressure of the cosmetic contents discharged by the airless pump (300) is reduced and the cosmetic contents are discharged through the discharge hole (701) at small quantity even under a low pressure.

* * * * *